United States Patent [19]

Piazza

[11] 4,186,536

[45] Feb. 5, 1980

[54] COMPOSITE BUILDING MODULE AND METHOD FOR MAKING SAME

[75] Inventor: Matthew R. Piazza, Nichols, Conn.

[73] Assignee: Maso-Therm Corporation, Bridgeport, Conn.

[21] Appl. No.: 884,921

[22] Filed: Mar. 9, 1978

[51] Int. Cl.[2] ..... E04C 2/20

[52] U.S. Cl. ..... 52/309.12; 264/46.4; 264/271

[58] Field of Search ..... 52/309.12, 405, 309.4, 52/309.8, 309.9; 264/46.8, 46.6, 46.4, 256, 257, 271; 428/121, 310, 316, 321, 310 HC

[56] References Cited

U.S. PATENT DOCUMENTS

| | | | |
|---|---|---|---|
| 3,100,952 | 8/1963 | Hall | 52/405 |
| 4,067,758 | 1/1978 | Sommer | 428/310 HC |

FOREIGN PATENT DOCUMENTS

| | | | |
|---|---|---|---|
| 2357336 | 6/1974 | Fed. Rep. of Germany | 52/405 |

OTHER PUBLICATIONS

French Publication 2,225,283 to A.R.C., published Nov. 1974; 8 pp. of spec. 1 sht. of dwing.

French Publication 2,241,669 to C.T.M. published Mar. 1975; 6 pp. of spec. 1 sht. of dwing.

*Primary Examiner*—John E. Murtagh

*Attorney, Agent, or Firm*—Sprung, Felfe, Horn, Lynch & Kramer

[57] ABSTRACT

A composite panel-like building module having a rigid foam core encapsulated in a shell and reinforced cementitious material having a facing member on one main face thereof, which may be a dry wall, and a process for making the composite module.

14 Claims, 8 Drawing Figures

COMPOSITE BUILDING MODULE AND METHOD FOR MAKING SAME

BACKGROUND

This invention relates to an improvement in composite modules especially those useful in building applications which is similar to monolithic cast concrete modules in outward appearance and use, yet has significant improvements in insulating properties and weight reduction. More particularly, this invention relates to a composite module having a rigid foam core encapsulated in a shell of reinforced cementitious material having a facing member, such as a dry wall, on one main face thereof.

Because of increased costs in material and labor, the construction industry has come to use prefabricated building modules, for example wall panels, roof decks and the like. A popular form of construction is known as "curtain-wall" construction and involves the use of a structural steel skeleton to which prefabricated or precast panels are attached. Such curtain-wall panels are commonly cast from reinforced concrete and are provided with a surface finish such as a smooth concrete finish or aggregate imbedded into the face of the panels. These panels are extremely heavy. For example, a four foot by eight foot curtain-wall panal cast from reinforced concrete weighs from about 1,400 to 1,600 pounds and requires heavy construction equipment to install. In addition, these panels provide very poor insulating properties and by themselves are a very poor vapor barrier. This makes necessary further construction to insulate and seal the pre-cast concrete curtain-wall.

The construction industry has long sought improved building elements that will offer advantages in material and construction costs.

The present invention provides a monolithic-like building module which is extremely light in weight as compared to pre-cast concrete panels for example and which has greatly improved insulating and vapor barrier properties per se and which has a face which can be used, as is, as an interior or exterior wall since it has the desired appearance of the facing member.

SUMMARY OF THE INVENTION

The composite panel-like building module of the present invention has a rigid foam core, for example rigid polyurethane foam having a density in the range of 2 to 5 pounds per cubic foot, encapsulated in a shell of reinforced cementitious material having a facing member on one main face thereof. The cementitious shell is reinforced with a first fibrous reinforcing material in discrete fiber form distributed in an interconnected random matrix substantially throughout the shell. A second fibrous reinforcing material in scrim form is disposed around the foam core and adjacent the shell and the facing member.

The composite module is made according to the present invention by providing a first mold having a bottom and side walls, disposing a facing member face down in the bottom of the mold, placing scrim reinforcing material on top of the facing member with excess scrim extending outwardly from the periphery thereof and foaming a foam core in situ on the facing member and scrim to a selected height.

A second mold is provided having a bottom and side walls wherein the area of the bottom of the second mold is greater than that of the first mold and the height of the side walls of the second mold is greater than the selected height, depositing a layer of wet cementitious material and fibers in the second mold, folding the excess scrim around the foam core and placing the core with facing member attached in the second mold on the bottom layer with the facing member face up and with the periphery thereof spaced from the side walls of the second mold, depositing wet cementitious material and fibers in the free space around the core and facing member to be substantially flush with the outer surface of the facing member and curing the wet cementitious material and removing the thus formed module from the second mold.

The excess scrim material can be either positioned in the first mold to extend over the side walls of the first mold or folded underneath the facing member prior to the foaming of the foam core in the first mold.

The bottom layer can be formed by depositing a premix of cement and files (e.g. ½" long) or by distributing lengths of fiber longer than the premixed fibers, preferably while vibrating the mold. The space around the core is filled with a premix of cement and fibers while vibrating.

The facing member may be a planar sheet of dry wall or may be any other type of desired textured or colored panel that is used either for the interior or exterior walls of a building.

BRIEF DESCRIPTION OF THE DRAWINGS

The present invention will be more fully understood from the following description taken in conjunction with the accompanying drawings wherein.

FIGS. *5a–5c* is a cross-sectional view showing the process steps in forming the module.

DETAILED DESCRIPTION OF THE PREFERRED EMBODIMENTS

Figure 1:
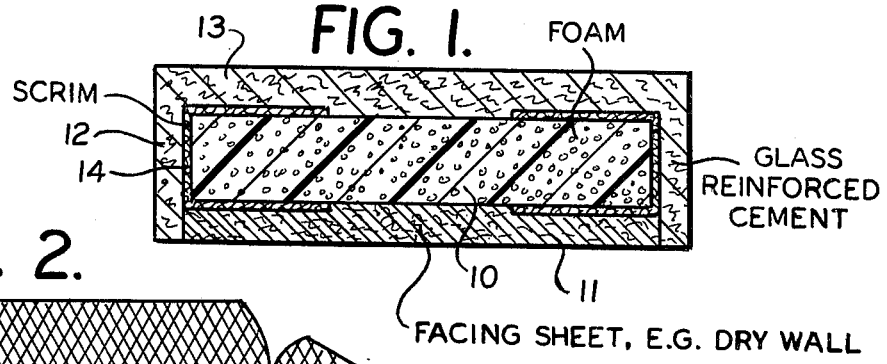
FIG. 1 is a cross-sectional view of a complete module according to the present invention.

Referring now to FIG. 1, the composite module of the present invention comprises a rigid foam core 10 having scrim reinforcing material 14 wrapped at least partly therearound and a rigid encapsulating shell 12 comprising reinforced cementitious material 13 and a facing member 11.

In a preferred embodiment, the cementitious material is reinforced with a glass fiber and the scrim reinforcing material is coated glass fiber scrim, while the rigid foam core is polyurethane foam.

The composite module is preferably a panel-like building module. The cementitious material is reinforced with fibrous reinforcing material in discrete fiber form which is preferably in two different fiber lengths. The shorter fibers are distributed in an interconnected random matrix throughout the shell 13, while the longer fibers are distributed in an interconnected random matrix together with the shorter fibers in the major surface portions of 13.

The combined use of short and long fibers has processing advantages in that the shorter fibers can be premixed with the cementitious material and the longer fibers can be deposited, for example, by cutting and chopping, in situ, during formation of the shell. This, together with the use of scrim reinforcing material 14 provides excellent reinforcement for the shell plus efficient processing. The premixed shorter fibers can be from about ¼to about ¾of an inch in length preferably about ½inch in length, and are present in an amount from 1 to 3% by weight, preferably about 2% by weight, based on the weight of the wet cement. The longer fibers which are preferably chopped and deposited during formation of the major surface portions of the shell 12 can be made up to 3 inches in length, preferably about 2 inches in length and are present in an amount of from about 1 to about 3% by weight, preferably about 2% by weight, based on the weight of the wet cementitious material. The total amount of fibrous reinforcement in both the shorter and longer fiber form and the scrim form is ideally about 5% by weight based upon the weight of the wet cementitious material. However, in practice it has been found that this can be reduced to about 4% by weight while still retaining the desired strength characteristics for the completed module.

FIGS. 2–5 show the various process steps involved in producing the module shown in FIG. 1.

The facing member 11 is placed face down in mold 20 and the scrim reinforcing material is thereafter positioned on the upper face of the facing member. The area of the scrim material 14 may greater than that of the facing member or, as shown, individual pieces may be placed down so that the excess scrim material 14' extends outwardly from the periphery of the facing member. In the embodiment shown in FIG. 2, the excess scrim material runs up the sides of the mold 20 and extends thereover while in FIG. 3, the excess scrim material 14' is folded underneath the facing member 11.

Figure 2:
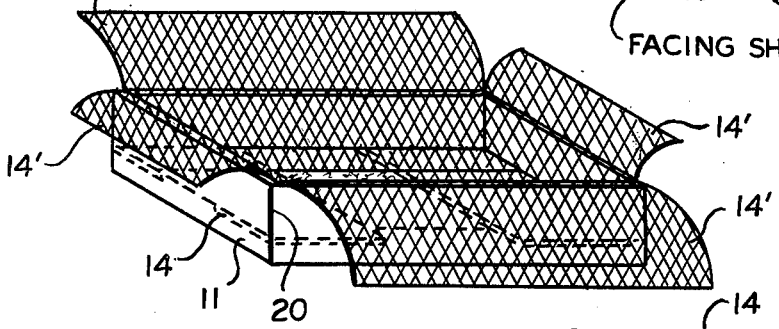
FIG. 2 is a perspective view showing one embodiment of the process of positioning the scrim material before foaming.
Figure 3:
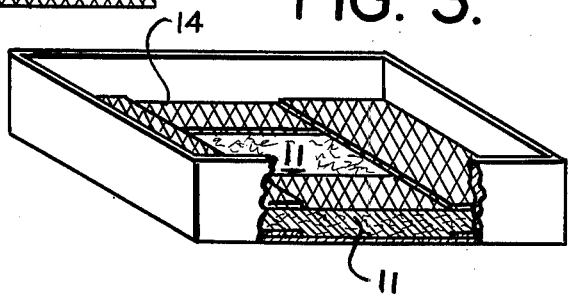
FIG. 3 is a cutaway perspective view of another embodiment of the process of positioning the scrim before foaming.
Figure 4:
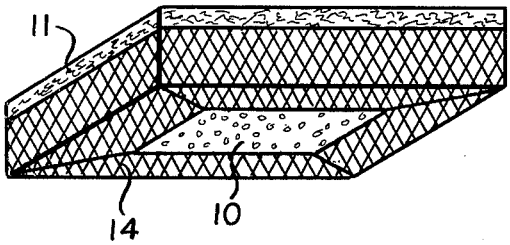
FIG. 4 is a perspective view of the foam core and facing member after removal from the first mold.

After the scrim material is positioned as in FIGS. 2 or 3, the foam is foamed into mold 20 and allowed to harden to form a rigid foam core member 10. The foam, in conjunction with the scrim material 14, is bonded to the exposed face of the facing member and the resulting unit is removed from mold 20 where the excess scrim 14' is then folded around the core 10 resulting in a unit as shown in FIG. 4.

A second mold 21 is then provided which has a bottom having an area greater than the bottom of mold 20 and thereby greater than the area of the facing member and core and the height greater than the height of the combined facing member and core.

Figure 5A:
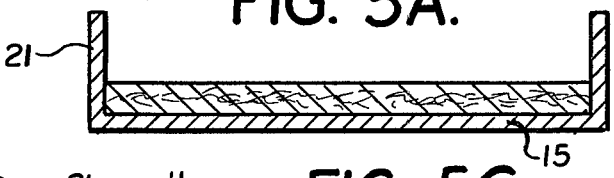
Figure 5B:
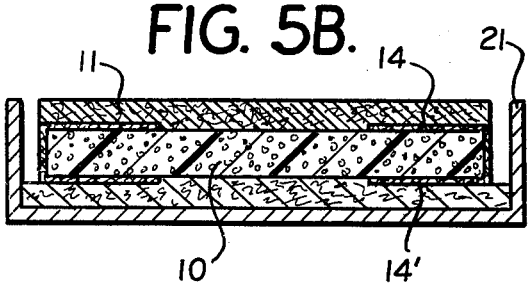

As shown in FIG. 5*a*, into the bottom of the mold 21 a wet cementitious bottom layer 15 is formed and thereafter the combined facing member and scrim wrapped core is placed in mold 21 with the facing member facing up and with the periphery of the facing member and core spaced from the side walls of the mold 21 as shown in FIG. 5*b*.

Figure 5C:
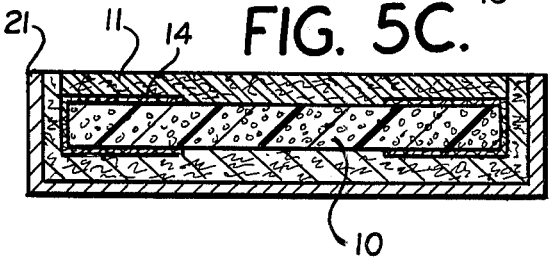

In accordance with FIG. 5*c*, wet reinforced cementitious material is then deposited in mold 21 in the free space surrounding the core and facing member until the cementitious material is substantially flush with the outer surface of the facing member.

Figure 6:
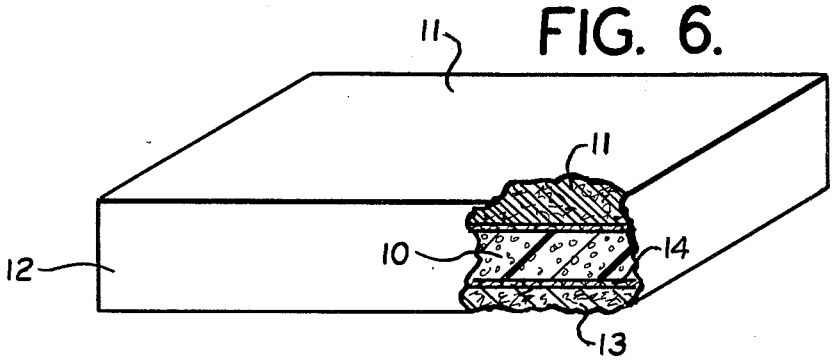
FIG. 6 is a cut-away perspective view of the module produced from the process of the present invention.

The cementitious material is allowed to cure and the module is removed from mold 21 in the form such as is shown in the partially cutaway perspective view of FIG. 6.

The term "scrim" is used herein to include woven non-woven fibers and can be course or fine so long as it is sufficiently open to allow the foam cementitious mixture to penetrate and wet the scrim layer itself. Generally the scrim reinforcing material will have a screen like appearance with openings as small as an eighth of an inch up to two inches or more, preferably with openings of about a quarter of an inch up to one inch. Naturally, the type and the configuration of the scrim reinforcing material will depend on the ultimate use for the module being produced. For example for roof deck panels or curtain-wall panels measuring approximately five by ten feet and four inches thick, a single layer of scrim with openings of approximately one half inch surrounding the foam core or adjacent to the major surfaces or around the edges has been found to provide adequate reinforcement for these particular applications.

The fibrous reinforcement in fiber form is preferably glass fiber chopped from rovings in lengths of one quarter to three inches and preferably from one to two inches. A preferred glass fiber is AR(alkali resistant) glass fiber sold under the trademark CEM-FIL and more particularly described in U.S. Pat. No. 3,901,720 issued Aug. 26, 1975.

For glass reinforced concrete (GRC), the generally recognized glass content is about five percent by weight with the glass fibers being distributed in an interconnected random matrix. However, through the use of a scrim reinforcing material (as mentioned above), the total amount of fiber reinforcement can be reduced to about four percent by weight. This results in increased efficiency in handling and cost savings.

Because of availability and cost, the preferred fibrous reinforcement (both short and long fibers) is glass fiber and preferably AR glass fiber, and the scrim reinforcing material is preferably a glass fiber scrim such as E glass fiber scrim coated to in part alkalai resistance to the glass for example with a polyester coating. However, other similar and equivalent fibrous materials can be used for the fibrous reinforcing materials within the context of the present invention. For example, the fiber and/or scrim reinforcing materials can be the same or different and can be made from aramid fiber such as KAVLAR by duPont, AR glass such as described above, nylon fibers, polyester fibers, and the like including natural and synthetic inorganic and organic fibers, for example graphite fibers. The scrim can also be made of a combination of fibers such as glass fiber and aramid fiber.

The cementitious material is preferably common cement in admixture with conventional fillers such as sand or pumice and can contain conventional additives such as lime and stearates for water resistance, latex for added strength and wetting ability with respect to the fiber reinforcement, and water reducing agents such as "Pozzilith" for quick setting. Conventional tints or dyes can also be used to provide the desired coloration.

It is also possible to use as a cementitious material a sulfur based product marketed under the trademark SUMENT by Chevron Chemical Company. This sulfur based material can be used in admixture with sand or other conventional fillers following known techniques for handling this type of material.

The glass fiber reinforcement can be incorporated into the cementitious material in an interconnected random matrix by premixing and/or by successively applying wet cementitious material and chopped and sprayed glass fiber. With conventional GRC where the glass content is generally about five percent by weight, premixing of the glass and cement is generally not possible without disturbing or destroying the glass fiber matrix. However, it is possible to premix and preserve the glass fiber matrix when using less glass for example two percent by weight glass. The present invention thus provides an additional advantage in being able to use a premix of wet cement and glass fibers preferably in combination with longer chopped and sprayed fibers.

Mechanical treatments can also be employed to work the glass fiber matrix into the wet cement mixture. For example rollers made of wire, grid or mesh can be applied to the mixture of glass fiber and cement and/or the scrim reinforcing material to insure thorough wetting of the reinforcing materials by the cement. The use of dilute latex can also assist in the wetting operation.

Suitable rigid foams include inorganic and organic foams. Rigid urethane polymer foams are preferred. These well known materials are widely used principally for insulation purposes. Urethane polymer foams are commonly formed by combining the reactants (a polyol and an isocyanate) using airless spraying or liquid application techniques. Foaming commences almost instantaneously and is completed within a very short period of time depending on the type of urethane polymer composition employed. The density of rigid urethane foams also depends on the nature of the urethane composition employed but generally ranges between about 1.5 pounds per cubic foot to 10 pounds per cubic foot, more commonly from 2 to 5 pounds per cubic foot. Other suitable rigid foams include polyester foams, phenolic resin foams, isocyanurate foams and sulfur based foams marketed under the trademark SUFOAM by Chevron Chemical Company.

It is preferred to form the cement glass fiber matrix by successively depositing chopped glass fibers and wet cement (preferably premixed with shorter glass fibers) while vibrating the mold. This insures complete wetting of the glass fibers by the cement without disturbing the glass matrix and also thorough filling of the free space between the core and the sides of the mold.

A preferred process of forming the bottom layer of the shell is by successfully depositing a premix of wet cementitious material and fibers and individual fibers longer than the premixed fibers. For example, wet cement premixed with one half inch glass fibers can be applied in the desired thickness and then chopped and sprayed glass fibers of two inches in length are applied to the set premix and rolled in to insure a complete wetting of the chopped fibers without breaking the matrix. The chopped fibers can be applied and rolled into the layer of premix in several steps if desired to reach the necessary level of glass loading for the bottom layer.

The free space around the edges of the core and facing member and the mold side walls is preferably filled with a premix of wet cement and two percent by weight glass fibers one half inch in length, preferably with vibration to insure complete filling of the free space and wetting of scrim material positioned in the free space.

A premix of cement and two percent of one-half inch glass fibers is prepared by first mixing a wetting agent such as methyl cellulose with one half inch glass fibers and then mixing the wet fibers with a mixture of cement and sand with the amount of water adjusted to compensate for the wetting agent added to the one half inch glass fibers. The pre-wetted glass fibers are added up to two percent by weight based on the weight of the wet cement to the mixture of cement and sand and the entire mixture is mixed further for a period of approximately five minutes before being used. This prevents cat balling of the glass fibers which results from over mixing.

The premix of wet cement and two percent one half inch glass fibers is then cast into the bottom of the mold to a thickness of three eighths of an inch. Chopped and sprayed glass two inches in length is then applied in several passes to the top of the bottom layer and rolled in after each pass to insure complete wetting of the chopped two inch glass fibers without breaking the matrix that results from the chopping and spraying operation.

To aid in filling distribution and wetting of the fibers the mold is vibrated intermittently during the application of the bottom and top layers and the filling of the free space between the mold side walls and the core.

As shown in FIGS. 2 and 3 the scrim material 14 can be positioned and pinned or secured in place by an adhesive.

The use of vibration insures complete filling and distribution and the avoidance of free spaces or parting lines. In curing the wet shell surrounding the foam core 10, the cement has a tendency to shrink and this places the fibers in the shell in tension around the rigid foam core and the facing member which resists the shrinking effect of the cement. The nature of the fiber reinforced cement shell is such that it is self supporting which means that it can be removed from the mold within a very short period after casting the shell about the core 10. Periods of an hour or more have been found to be sufficient before removing the partially cured module from the mold and curing is completed by keeping the module wet for periods of up to three to five days.

After fabrication of the module is complete the cement is allowed to cure under ambiant conditions or preferably in a stem heated curing enclosure. Curing can also be accelerated using hot wet cement made with water at about 122°–200° F. Once the cement is cured the composite module is removed from the mold and is ready for use.

The facing member may be any preformed panel such as a dry wall, and may be provided with any desired finished texture or design and can have imbedded therein inorganic aggregates such as gravel, broken stone, marble chips and the like.

The composite module of the invention can be used and installed in the same manner as conventional building modules such as pre-cast curtain-wall panels but because of the great reduction in weight simplified installation procedures are possible. Because of the greatly improved insulating and water vapor barrier properties the modules of the invention, no further steps have to be taken to insure these properties as is the case with conventional building modules.

In roof deck installations or curtain-wall installations, a room temperature curing elastomer such as a silicone elastomer can be used for edge-to-edge bonding between adjacent modules and the entire installation can be provided with an overcoating of a suitable elastomer. This provides for a shock resistant installation which can also compensate for later movement of a structure for example as a building settles after construction. The edge of the modules according to the invention can also be provided with one or more semi-circular longitudinal grooves to facilitate the use of flexible bead material made for example from synthetic polymer foams such as polyethylene positioned between adjacent modules to provide sealing against moisture and air.

Typical properties of commerically available rigid urethane polymer foams are set forth in the following table:

TYPICAL RIGID URETHANE FOAM PROPERTIES

| Density lb./cu. ft. Astm D 1622 | Compressive Strength psi Astm D 1621 | Compressive Modulus psi Astm D 1621 | Shear Strength psi | Shear Modulus psi |
|---|---|---|---|---|
| 1.5-2.0 | 20-60 | 400-2000 | 20-50 | 250-550 |
| 2.1-30 | 35-95 | 800-3500 | 30-70 | 350-800 |
| 3.1-45 | 50-185 | 1500-6000 | 45-125 | 500-1300 |
| 4.6-70 | 100-350 | 3800-12,000 | 75-180 | 850-2000 |

What is claimed is:

1. Process for making a composite panel-like building module having a rigid foam core encapsulated in a shell of reinforced cementitious material having a facing member on one main face thereof, comprising:

a. providing a first mold having a bottom and side walls;

b. disposing a facing member face down in the bottom of the mold;

c. placing scrim reinforcing material on top of the facing member with excess scrim extending outwardly from the periphery of the facing member;

d. foaming a foam core in situ on the facing member and scrim to a selected height;

e. providing a second mold having a bottom and side walls wherein the area of the bottom wall of the second mold is greater than that of the first mold and the height of the side walls of the second mold is greater than said selected height;

f. depositing a layer of wet cementitious material and fibers in the bottom of the second mold.

g. folding the excess scrim around the foam core produced in step (d) and placing the core and facing member in the second mold on the bottom layer with the facing member face up and with the periphery thereof spaced from the side walls of the second mold;

h. depositing wet cementitious material and fibers in the free space around the core and facing member to be substantially flush with the face of the facing member; and i. curing the wet cementitious shell and removing the thus formed module from the second mold.

2. The process according to claim 1, further comprising distributing lengths of fiber longer than the premixed fibers in the bottom layer.

3. The process according to claim 2, wherein the distributing step is carried out while vibrating the mold.

4. The process according to claim 1, wherein the excess scrim material is positioned to extend over the side walls of the first mold.

5. The process according to claim 1, wherein the excess scrim material is folded underneath the facing member.

6. The process according to claim 1, wherein the facing member comprises a sheet of dry wall.

7. A composite panel-like building module comprising: a rigid foam core encapsulated in a shell of reinforced cementitious material having one main face thereof comprising a facing member, the module formed by disposing the facing member face down in the bottom of a first mold having first side walls, placing scrim reinforcing material on top of the facing member with excess scrim extending outwardly from the periphery of the facing member, foaming a foam core in situ on the facing member and scrim to a selected height, depositing a layer of wet cementitious material and fibers in the bottom of a second mold having a greater area than that of the first mold and a height greater than the selected height, folding the excess scrim around the foam core and placing the core and facing member in the second mold on the bottom layer with the facing member face up, and with the periphery thereof spaced from the side walls of the second mold, depositing wet cementitious material and fibers in the free space around the core and facing member to be substantially flush with the face of the facing member and curing the wet cementitious sheel and removing the thus formed module from the second mold.

8. The module according to claim 7, wherein lengths of fiber longer than the premixed fibers are distributed in the bottom layer.

9. The module according to claim 8, wherein the mold is vibrated during the distributing of the fibers.

10. The module according to claim 7, wherein the excess scrim material is positioned to extend over the side walls of the first mold.

11. The module according to claim 7, wherein the excess scrim material is folded underneath the facing member.

12. The module according to claim 7, wherein the facing member comprises a sheet of dry wall.

13. A composite panel-like building module comprising: a shell of reinforced cementitious material comprising one main surface and a plurality of side walls each having a given height; a foam core disposed in the shell and having a height less than said given height, said foam core wrapped in a reinforcing scrim material; a facing member having a main face and disposed on said core and within the side walls and in sealing contact therewith, wherein the main face thereof is substantially flush with the top of the side walls to thereby encapsulate the foam therein wherein the foam core is foamed in situ on the face of the facing member opposite the main face and which is covered with scrim material and has excess scrim extending therewithout, wherein the excess scrim material is thereafter wrapped around the foam core, and wherein the cementitious shell is formed around the attached foam core and facing member.

14. The module according to claim 13, wherein the excess scrim material is folded underneath the facing member when the foam core is foamed thereon.

* * * * *